US006412734B2

(12) United States Patent
Lin

(10) Patent No.: US 6,412,734 B2
(45) Date of Patent: Jul. 2, 2002

(54) GOLF BAG SUPPORT DEVICE

(76) Inventor: Ming-Tsung Lin, 63, Fang Tsao Street, Chan Hua (TW)

( * ) Notice: Subject to any disclaimer, the term of this patent is extended or adjusted under 35 U.S.C. 154(b) by 0 days.

(21) Appl. No.: 09/567,765

(22) Filed: May 9, 2000

(51) Int. Cl.[7] ..... A63B 55/00
(52) U.S. Cl. ..... 248/96; 206/315.7
(58) Field of Search ..... 248/96, 97; 206/315.7, 206/315.3

(56) References Cited

U.S. PATENT DOCUMENTS 5,540,431 A * 7/1996 Crozier ..... 473/282
5,681,016 A * 10/1997 Wang ..... 248/96
5,901,845 A * 5/1999 Chen ..... 206/315.7

* cited by examiner

*Primary Examiner*—Ramon O. Ramirez
*Assistant Examiner*—Holly N. Sy
(74) *Attorney, Agent, or Firm*—Rabin & Berdo, P.C.

(57) ABSTRACT

A golf bag support device includes a support secured to bag having an opening on a side and a recess adjacent the opening, a flexible member open at the top and one side having a corrugated surface secured to the recess and a bottom attached to the corrugated surface, a flexible extension member with one end pivotably attached to the bottom of the flexible member and the other ends pivotably attached at predetermined positions on the legs, and two legs with top ends pivotably attached to the top edge of golf bag. In operation, the bag is pulled outward such that the corrugated surface is compressed by the weight of bag and golf clubs and extension member is bent to cause the legs to extend outward to form an angle with respect to the bag. This forms a three-legged support by the legs, support, and flexible member for the bag. Further, the clubs are extended above the bag due to the compression of the flexible member. This facilitates the access of golf clubs. Moreover, this device is aesthetic.

4 Claims, 7 Drawing Sheets

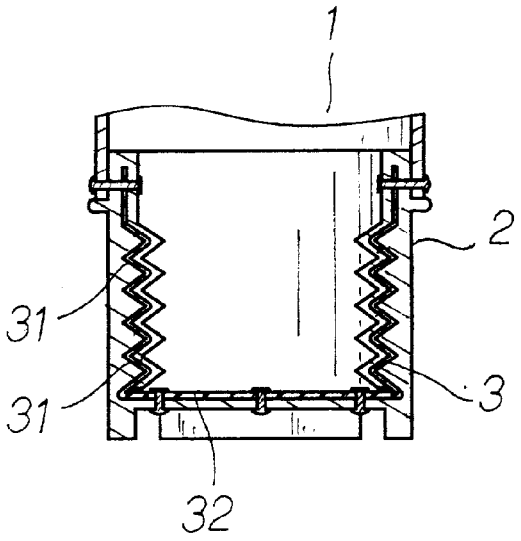
FIG.2-B
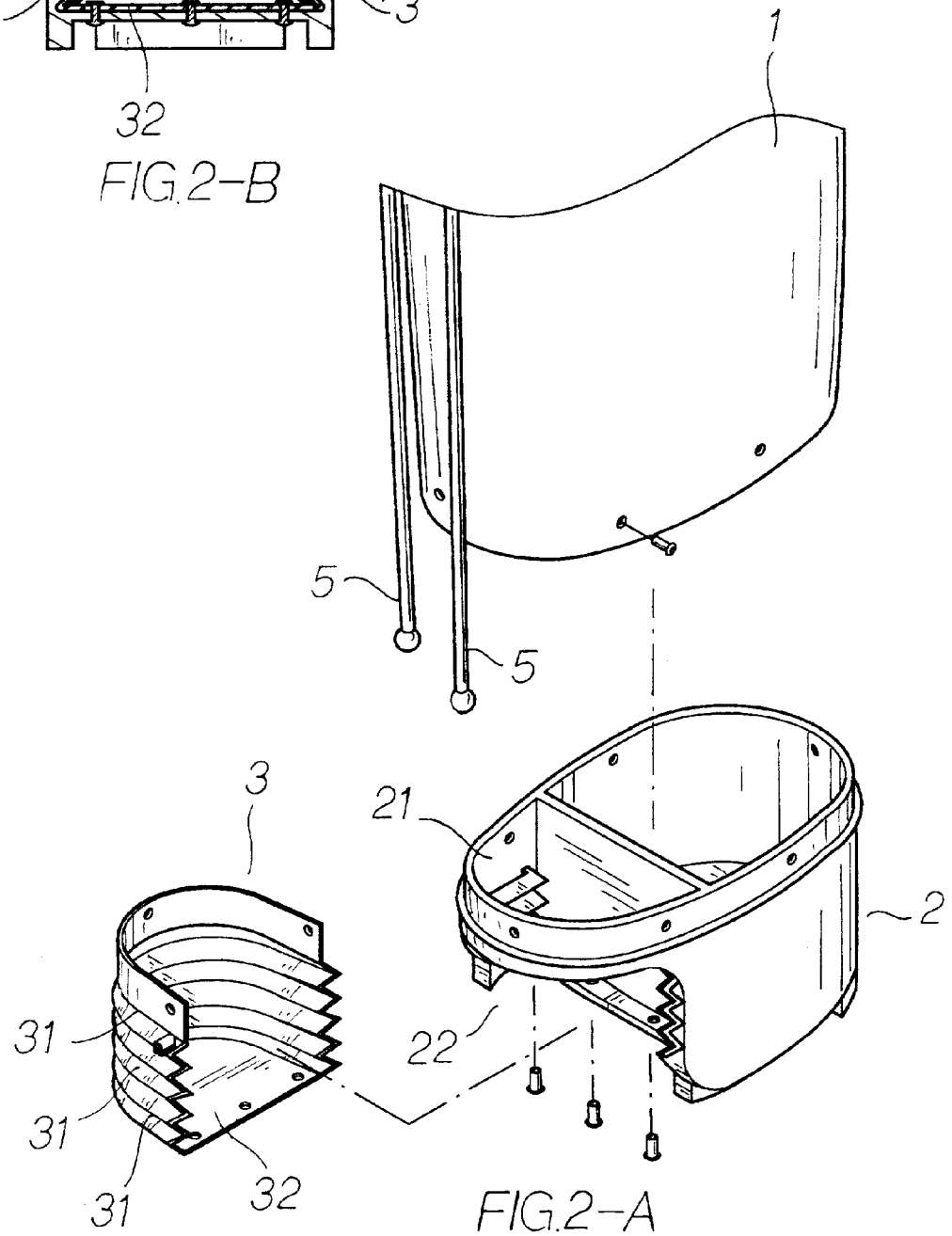
FIG.2-A

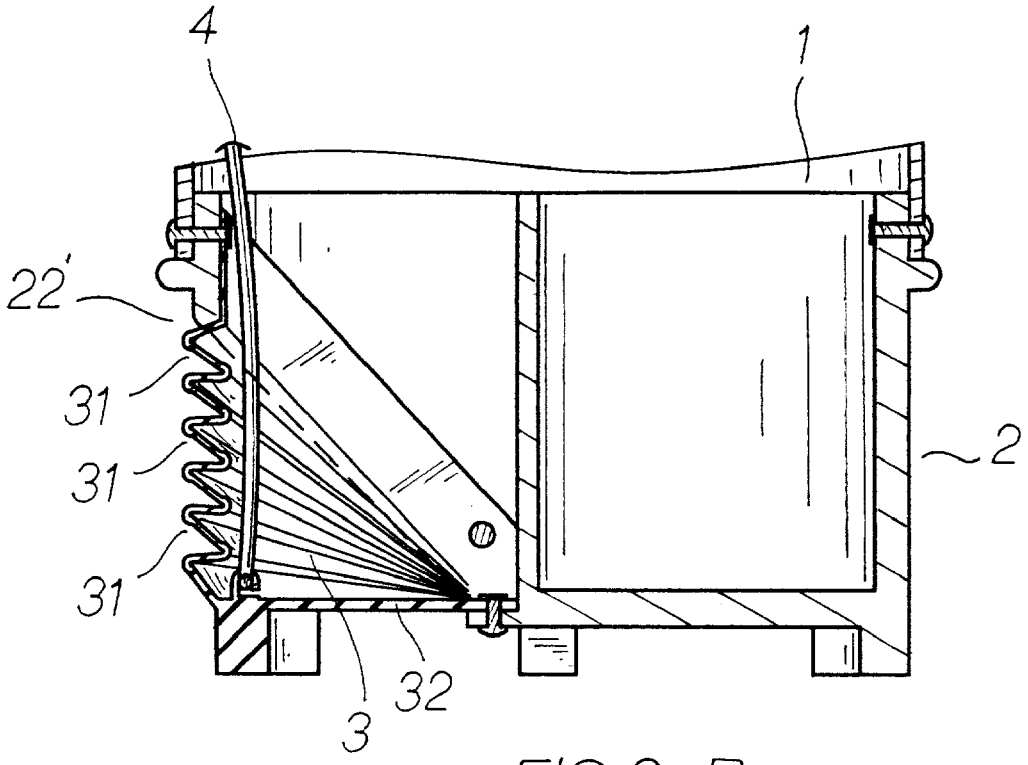
FIG. 3-B
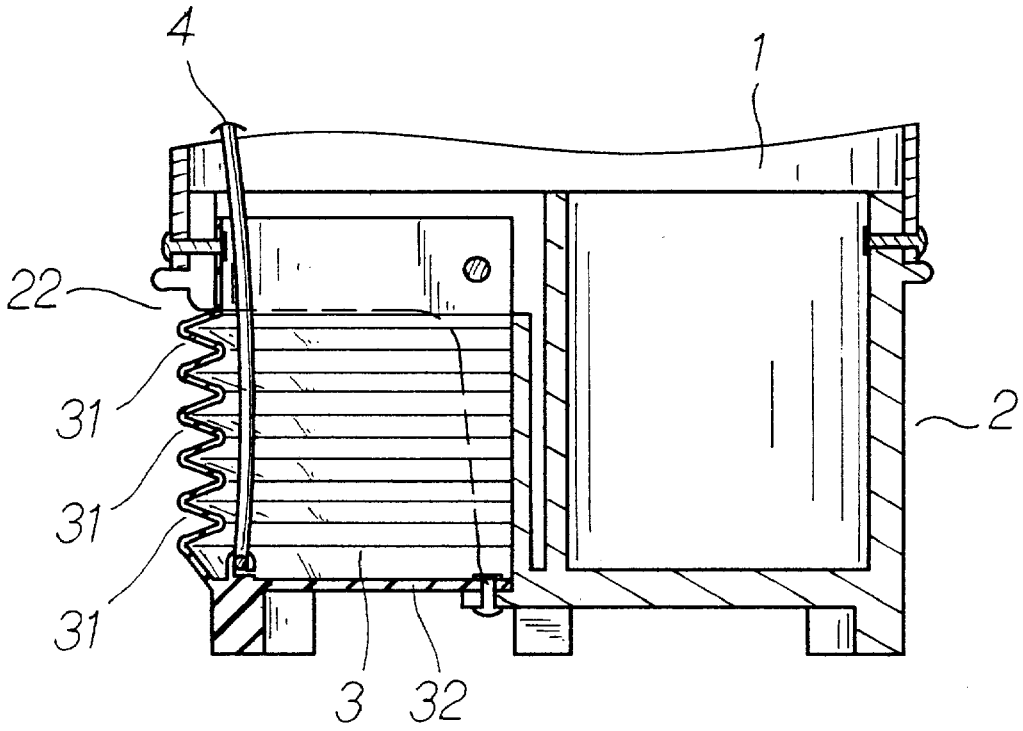
FIG. 2-C

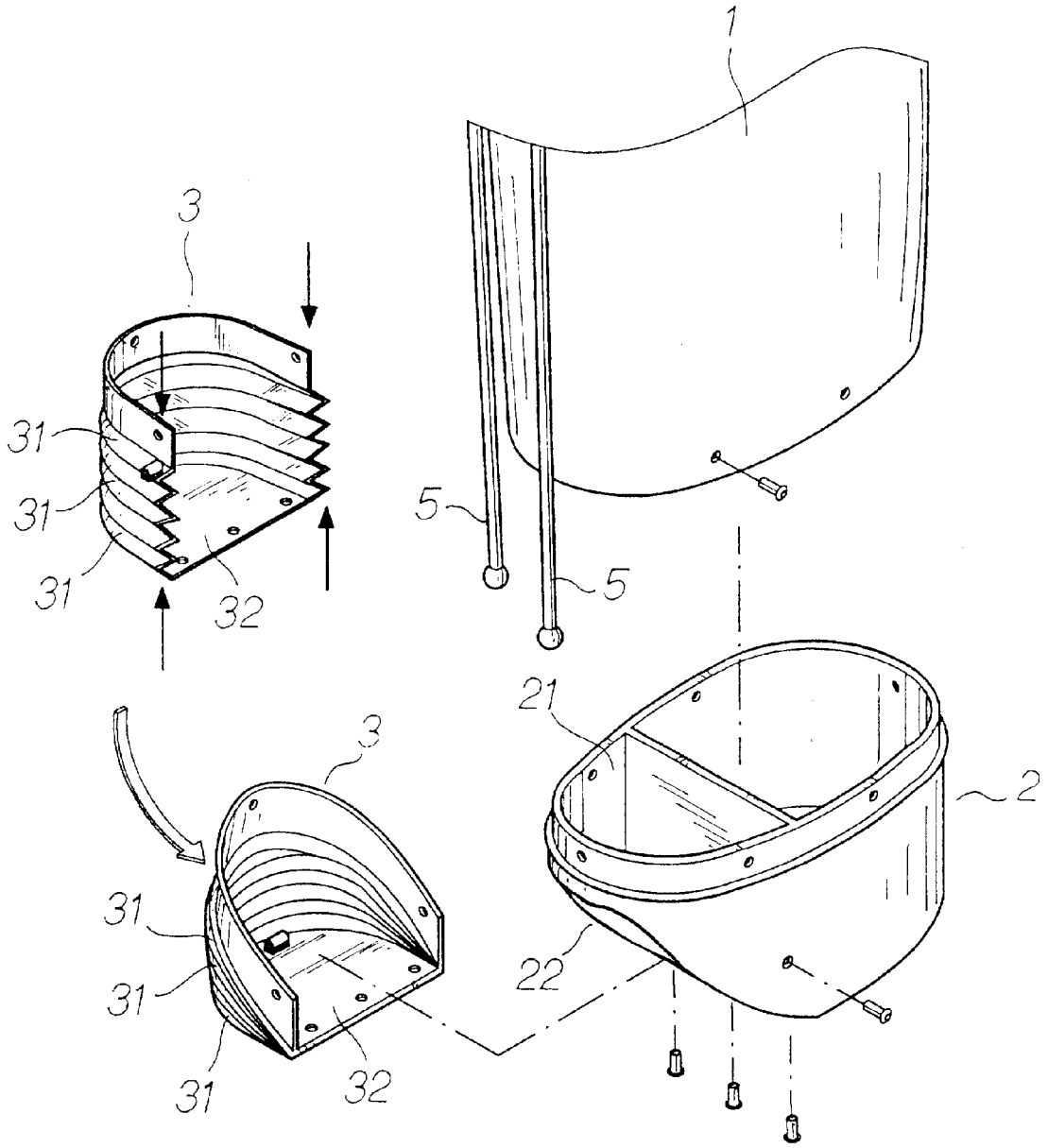
FIG.3-A

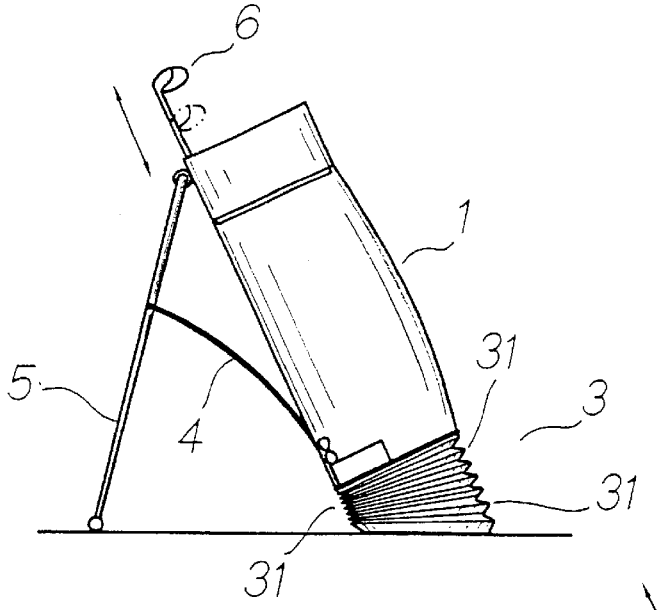
FIG. 4-D
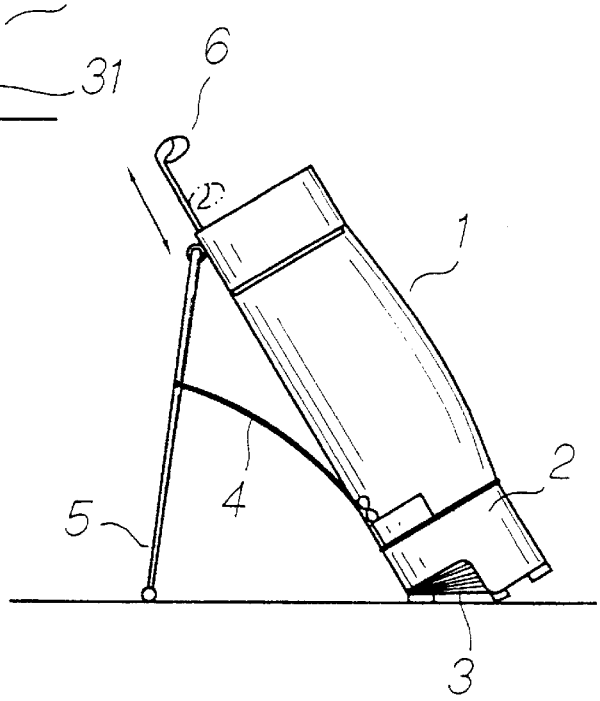
FIG. 2-D
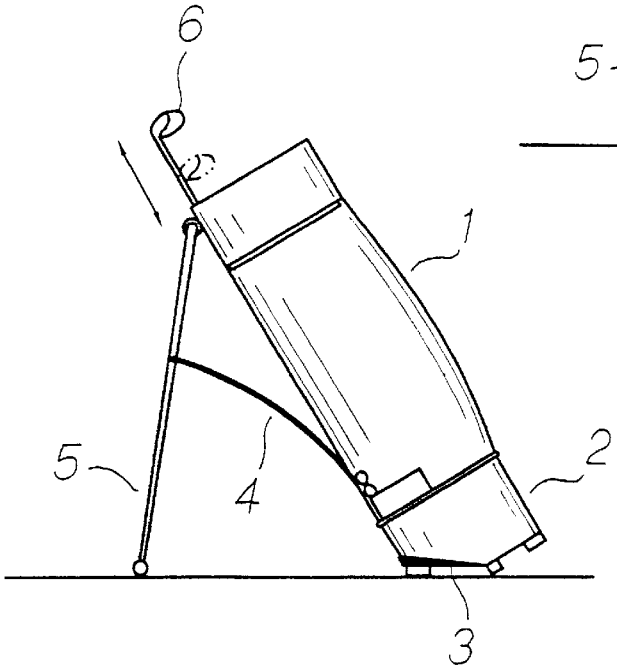
FIG. 3-C

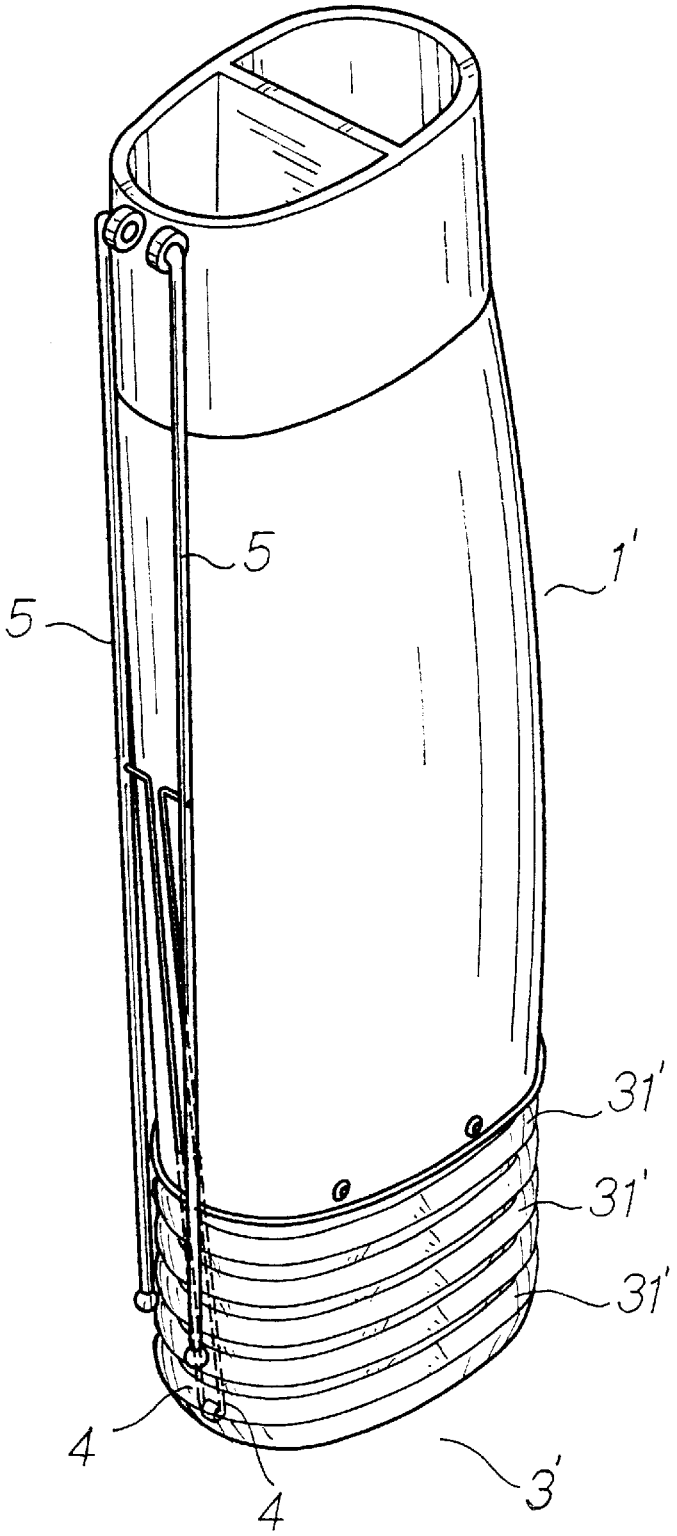
FIG. 4-A

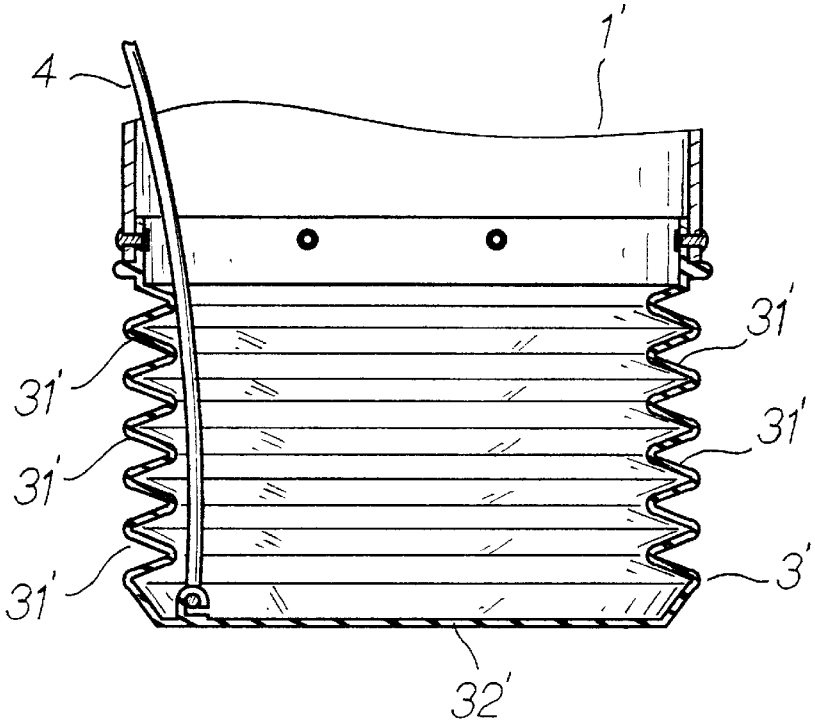
FIG. 4-B
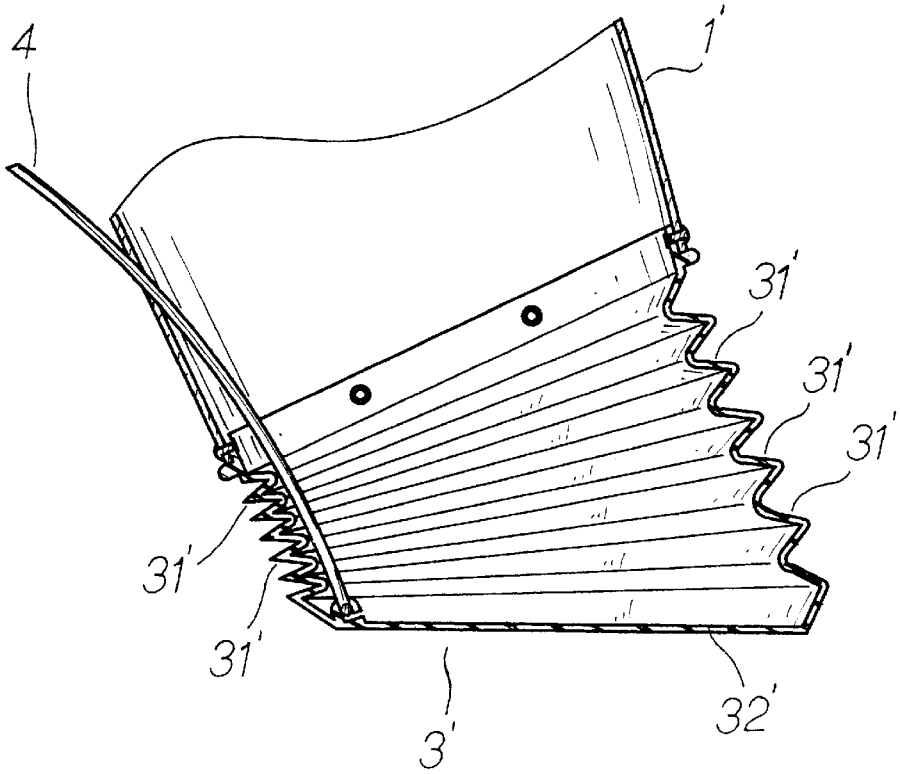
FIG. 4-C

GOLF BAG SUPPORT DEVICE

FIELD OF THE INVENTION

The present invention relates to a support device and more particularly to a golf bag support device.

BACKGROUND OF THE INVENTION

A conventional golf bag with a support device is shown in FIG. 1. This support device includes a bag A, two legs B pivotably attached to bag A, and a support C pivotably attached to legs B. In use, a user may pull bag A outward to form an angle with respect to legs B (i.e., inclined) for stably placing bag A on the ground. However, the previous design suffered from two disadvantages:

1. It is unsightly because base C1 is disposed between extended legs B and bag 2. It is not stable due to the flat surface contact between base C1 and the ground. In practice, the golf bag is susceptible to falling when a foreign object slightly collides with it.

An improvement is to make a corrugated base C1 for enhancing the stability. However, the appearance of the whole golf bag is still not pleasant.

SUMMARY OF THE INVENTION

It is thus an object of the present invention to provide a golf bag support device. The golf bag has the advantages of being stable when standing, easy to access golf clubs, and aesthetic. The support device includes a support threadedly secured to the bottom of the golf bag, and having an opening on a side and a recess with toothed-shape edges adjacent to the opening; a flexible member open at the top and one side having a corrugated surface with tooth-shaped edges matingly corresponding to the recess and a bottom attached to the corrugated surface; a flexible extension member with one end pivotably attached to the bottom of the flexible member and the other ends pivotably attached at predetermined positions of the legs; and two legs with top ends pivotably attached to the top edge of the golf bag. In operation, the bag is pulled outward such that the corrugated surface of the flexible member is compressed by the weight of the bag and golf clubs, and an extension member is bent to cause the legs to extend outward to form an angle with respect to the bag. This forms a three-legged support by the legs, support, and flexible member for the golf bag. As a result, the golf bag is stably inclined against the ground. Further, the grips of golf clubs are extended above the opening of the bag due to the compression of the flexible member. This facilitates the access of the golf clubs. Moreover, this golf bag support device is aesthetic.

It is another object of the present invention to provide a golf bag support device wherein the support is omitted and the flexible member is made as a hollow body with a corrugated surface and a bottom being directly secured to the bag.

The above and other objects, features and advantages of the present invention will become apparent from the following detailed description taken with the accompanying drawings.

BRIEF DESCRIPTION OF THE DRAWINGS

FIG. 2 is a partial exploded view of a first preferred embodiment of a golf bag support device according to the invention;

FIG. 2B sectional view of the assembled golf bag support device of FIG. 2A;

FIG. 2C is a another sectional view of the assembled golf bag support device of FIG. 2A;

FIG. 2D is a side view of the golf bag support device of FIG. 2A where the golf bag is inclined by the support of the support device;

FIG. 3A is a partial exploded view of a second preferred embodiment of the golf bag support device according to the invention;

FIG. 3B is a sectional view of the assembled golf bag support device of FIG. 3A;

FIG. 3C is a side view of the golf bag support device of FIG. 3A where the golf bag is inclined by the support of the support device;

FIG. 4A is a perspective view of a third preferred embodiment of the golf bag support device according to the invention;

FIG. 4B is a sectional view of the uncompressed flexible member of FIG. 4A;

FIG. 4C is a similar to FIG. 4B where the flexible member is compressed; and FIG. 4D is a side view of the golf bag support device of FIG. 4A where the golf bag is inclined by the support of the support device.

DETAILED DESCRIPTION OF THE PREFERRED EMBODIMENTS

Figure 1:
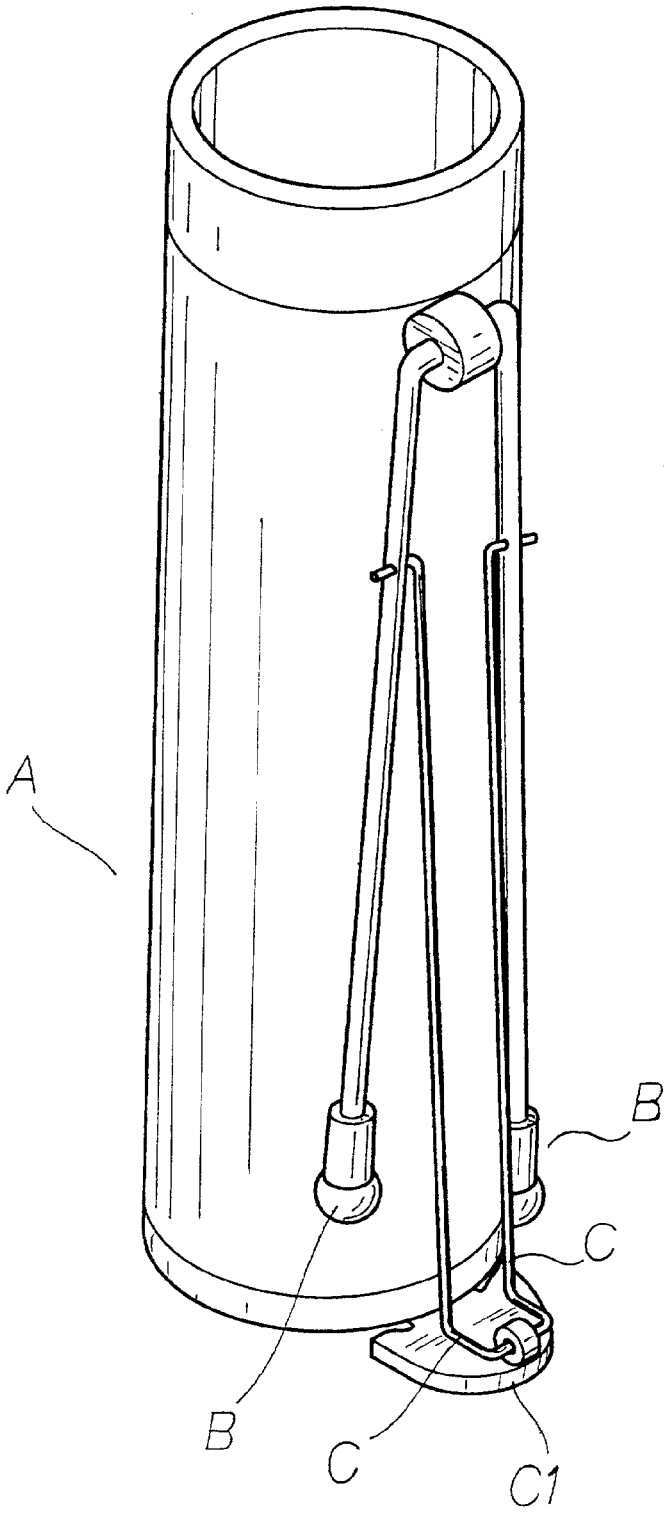
FIG. 1 PRIOR ART
FIG. 1 is a perspective view of a conventional golf bag support device.

Referring to FIGS. 2A to 2D, there is shown a golf bag support device constructed in accordance with the invention; including a support 2, a flexible member 3, a flexible extension member 4, and two legs 5. Each of the above components is detailed below.

Support 2 is threadedly secured to the bottom of golf bag 1. Support 2 has an opening 21 on a side and a recess 22 with toothed-shape edges adjacent the opening 21. Flexible member 3 is open at the top and one side. Flexible member 3 has a corrugated surface 31 with toothed-shape edges matingly corresponding to the recess 22, and a bottom 32 attached to the corrugated surface 31. One end of flexible extension member 4 is pivotably attached to the bottom of flexible member 3, while the other ends are pivotably attached at predetermined positions of legs 5. The top ends of legs 5 are also pivotably attached to the top edge of golf bag 1.

In operation, the user first pulls bag 1 outward. At this time, the corrugated surface of flexible member 3 is compressed by the weight of bag 1 and golf clubs 6. As such, extension member 4 is bent to cause legs 5 to extend outward to form an angle with respect to bag 1 (i.e., inclined). This forms a three-legged support (i.e., legs 5, support 2, and flexible member 3) for the golf bag 1. As a result, golf bag 1 is stably inclined against the ground. Further, the grips of golf clubs 6 are extended above the opening of bag 1 due to the compression of flexible member 3. This facilitates the access of golf clubs 6. Moreover, this golf bag support device is aesthetic.

FIGS. 3 to 3C illustrate a second preferred embodiment of the golf bag support device according to the invention. The support 2 and flexible member 3 of this embodiment are generally the same construction as that of the first embodiment with the exception of pressing the sides of corrugated surface 31 facing support 2 to from a slant portion. Correspondingly, the portion of support 2 facing the flexible member 3 is also formed as a slant portion. As such, support 2 and flexible member 3 may be matingly secured together by fasteners. The description and operation of other components of the golf bag support device are omitted herein because they are the same as the first embodiment.

FIGS. 4A to 4D illustrate a third preferred embodiment of the golf bag support device according to the invention wherein support 2 is omitted and flexible member 3' is made as an elliptic hollow body with corrugated surface 31' and bottom 32'. Flexible member 3' is directly secured to bag 1'. The description and operation of other components of the golf bag support device are omitted herein because they are the same as the first embodiment.

While the invention herein disclosed has been described by means of specific embodiments, numerous modifications and variations could be made thereto by those skilled in the art without departing from the scope and spirit of the invention set forth in the claims.

What is claimed is:

1. A support device for a golf bag adapted to store a plurality of golf clubs therein, comprising:

a support adapted to be secured to a bottom of the golf bag, said support having a recess on a side thereof;

a flexible member secured to said support in a region of the recess, and having an open top in communication with the recess, a side having a corrugated surface, and a bottom attached to the corrugated surface;

two legs with top ends adapted to be pivotally attached to a top edge of the golf bag; and a flexible extension member having one end pivotally attached to the bottom of said flexible member and having another end pivotally attached at predetermined positions on said legs;

wherein in operation, when the golf bag is pulled outward, the corrugated surface is compressible by a weight of the golf bag and the golf clubs, and said extension member is bent to cause said legs to extend outward to form an angle with respect to the golf bag, resulting in a three-legged support for the golf bag by said legs, said support, and said flexible member, and grips of the golf clubs are extendible above the golf bag due to the compression of said flexible member.

2. A support device for a golf bag adapted to store a plurality of golf clubs therein, comprising:

a flexible member adapted to be directly secured to a bottom of the golf bag, and having a hollow body having a corrugated surface, and a bottom attached to the corrugated surface;

two legs with top ends adapted to be pivotally attached to a top edge of the golf bag; and a flexible extension member having one end pivotally attached to the bottom of said flexible member and having another end pivotally attached at predetermined positions on said legs;

wherein in operation, when the golf bag is pulled outward, the corrugated surface is compressible by a weight of the golf bag and the golf clubs, and said extension member is bent to cause said legs to extend outward to form an angle with respect to the golf bag, resulting in a support for the golf bag by said legs, and said flexible member, and grips of the golf clubs are extendible above the golf bag due to the compression of said flexible member.

3. In combination, a golf bag adapted to store a plurality of golf clubs therein: and a support device, comprising:

a flexible member disposed at a bottom of said golf bag, and having an open top in communication with an interior of said golf bag, a side having a corrugated surface, and a bottom attached to the corrugated surface;

at least one leg pivotally attached to a top edge of the golf bag; and a flexible extension member having one end pivotally attached to the bottom of said flexible member and having another end pivotally attached to said leg;

wherein in operation, when said golf bag is pulled outward, the corrugated surface is compressed by a weight of the golf bag and the golf clubs, and said extension member is bent to cause said leg to extend outward to form an angle with respect to said golf bag, resulting in a support for the golf bag by at least said leg and said flexible member, and grips of the golf clubs are extendible above the golf bag due to the compression of said flexible member.

4. The combination recited in claim 3, wherein said support device further comprises a support secured to the bottom of the golf bag, said support having an opening in communication with the interior of said golf bag, and a recess on a side thereof, said flexible member being secured to said support in a region of the recess, the open top of said flexible member being in communication with the recess.

* * * * *